US005620298A

United States Patent [19]

Barwise

[11] Patent Number: 5,620,298

[45] Date of Patent: Apr. 15, 1997

[54] SKIDDING GRAPPLE

[76] Inventor: Robert D. Barwise, 366 County Rd. 339, Bovey, Minn. 55709

[21] Appl. No.: 514,568

[22] Filed: Aug. 14, 1995

[51] Int. Cl.[6] ..... B66C 1/00

[52] U.S. Cl. ..... 414/734; 294/86.4; 294/88

[58] Field of Search ..... 414/734, 739, 414/738, 729, 912; 294/86.4, 86.41, 111, 112, 88

[56] References Cited

U.S. PATENT DOCUMENTS

| | | | |
|---|---|---|---|
| Re. 29,805 | 10/1978 | Koehnen . | |
| 3,841,507 | 10/1974 | Barwise . | |
| 3,860,282 | 1/1975 | Johnson | 294/112 |
| 4,217,076 | 8/1980 | Robnett et al. . | |
| 4,315,652 | 2/1982 | Barwise . | |
| 5,016,671 | 5/1991 | Barwise . | |
| 5,141,386 | 8/1992 | Barwise . | |

FOREIGN PATENT DOCUMENTS

| | | | |
|---|---|---|---|
| 1323058 | 10/1993 | Canada . | |
| 751794 | 7/1980 | U.S.S.R. | 294/86.4 |

OTHER PUBLICATIONS

Brochure entitled *Hydrawrap The New Concept in Skidding.*
Brochure entitled *Clark 655D Grapple Skidder Specificationas,* four pages, Nov., 1982.

*Primary Examiner*—Donald W. Underwood
*Attorney, Agent, or Firm*—Burd, Bartz & Gutenkauf

[57] ABSTRACT

A skidding grapple to move a load such as a tow of logs, over a terrain that is particularly difficult to traverse. A grapple assembly to engage the load has offset grapple arms that bypass one another when closing to encompass the load. A choke line is connected at one end to the winch line, and has first and second choke line legs that connect to the ends of the grapple arms. As the grapple arms close, the choke line legs form a noose to engage the end of the load and bear the weight of the load upon lifting of the grapple arms. A coupling releasably connects the grapple assembly to the boom. A winch line extends over the boom end, past the coupling and is connected to the grapple assembly, such that upon release of the grapple assembly from the boom, it remains connected to the tow vehicle by the winch line. Reconnection of the coupling assemblies is facilitated, since the winch line passes over the boom tip and results in alignment with the coupling assemblies as they come together.

19 Claims, 8 Drawing Sheets

SKIDDING GRAPPLE

BACKGROUND OF THE INVENTION

Grapple skidders are used to transport loads or drags of logs or trees out of the woods for further processing. The end of the load is carried by a grapple assembly, and is typically snugged up against the butt of the vehicle or carried by a trailer towed by the vehicle. Another form of log skidder is the choker-winch line cable skidder where the load is simply dragged by a winch line connected to the tow vehicle. Grapple skidding is generally acknowledged to have certain advantages over the choker skidding, particularly in terms of production, operator safety and comfort. A grapple assembly is suspended from a boom and is usually hydraulically operated to open and close about the drag of logs. Vehicle maneuverability can be less than that afforded by the cable skidder vehicle. For this reason, there has developed in the prior art load handling machines that are grapple skidders that can release the grapple-engaged a load, and tow it with a winch line in performance of a skidder-type operation. For example, see U.S. Pat. Nos. to Barwise, 4,315,652, issued Feb. 16, 1982; 5,141,386, issued Aug. 25, 1992; and, 3,841,507.

A need has evolved for an even more efficient skidding grapple machine. The logging industry is in a constant state of change in order to satisfy the economical and ecological demands of society. Deep ruts from skidder tire or tracks, soil disturbance and compaction, or indiscriminate bulldozing of logging roads or landing sites, is less tolerated than before.

SUMMARY OF THE INVENTION

The invention relates to a skidding grapple for transport of trees or portions thereof from a felling site to a predetermined gathering site for further preparation or transport to a mill for final utilization. The skidding grapple has a releasable grapple assembly to permit towing behind the vehicle, separated from the vehicle and connected to it only by a winch line. The grapple assembly has a grapple head and tines. The tines are of a bypass design. Ends of a crotch chain are attached to the outer extremity of each of the tines. A third chain leg or stem is coextensive with the end of the winch line. A centrally-open coupling connects the grapple assembly to the boom. The winch line extends through the coupling and the boom, over appropriate rollers to the winch drum. When the grapple tines are closed about a load, the offset grapple ends bypass one another. The legs of the chain form a noose about the load, encompassing the bottom portion thereof. The top of the load is snugged up against the grapple yoke upon tensioning of the winch line. The weight of the load is borne by the chain and not by the grapple tines.

The winch line extends from the chain noose legs, through a rotatable hollow hub that is part of the coupling connecting the grapple assembly to the boom, through the goose neck of the boom and forward to the winch drum.

With the grapple engaging a load, the grapple assembly can be disconnected from the boom in order to skid the load over difficult terrain. In this configuration, the grapple assembly and load are connected to the tow vehicle only by the winch line. At the end of the tow procedure, the load is brought up to the vehicle skidder by spooling in the winch line. The coupler has one part connected to the boom and the other part connected to the grapple assembly. The coupler brings together hydraulic connectors to connect the grapple assembly hydraulic power unit to a supply of hydraulic fluid.

Since the winch line is drawn through the coupler units, alignment of the grapple assembly coupling to the boom is facilitated.

IN THE DRAWINGS

FIG. 1 is a side elevational view of a skidding grapple according to the invention, engaging a load or drag of logs, but not yet having the load snugged up to the butt of the skidder;

DESCRIPTION OF A PREFERRED EMBODIMENT

Figure 4:
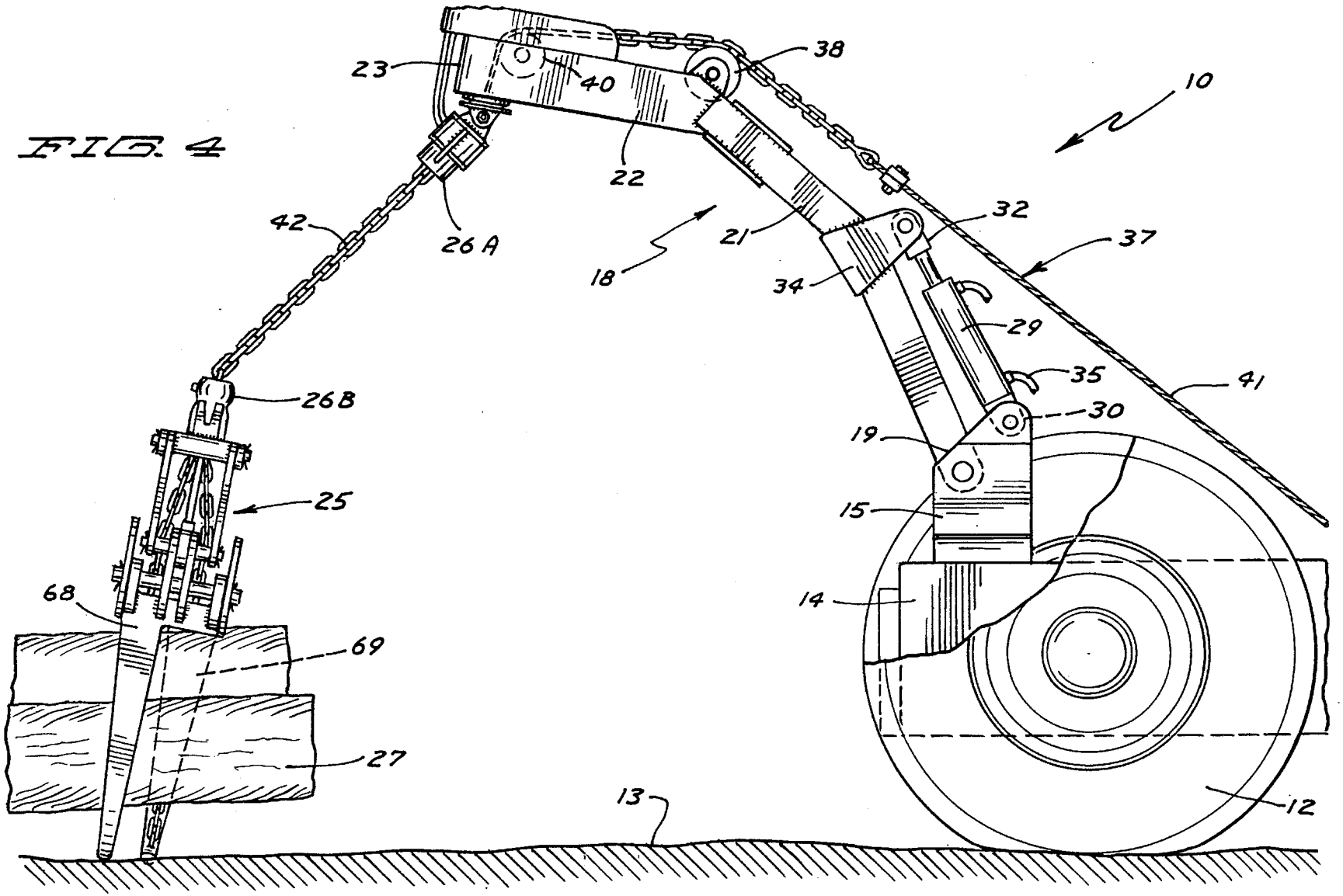
FIG. 4 is a side elevational view of a skidding grapple with the grapple assembly and load detached from the skidder vehicle and connected to it only by the winch line.

Referring to FIGS. 1 and 4, a skidding grapple according to the invention is indicated generally at 10. The skidding grapple 10 includes a tow vehicle 11 riding conventionally on tires 12 supported on a ground surface 13. Wheels 12 are mounted rearwardly with respect to a frame 14 of the vehicle 11. The butt end of the frame 14 has boom mounts 15. Frame 14 carries a winch drum 17. A boom assembly 18 has a boom foot 19 that is mounted to the boom mounts 15.

The boom assembly 18 has an intermediate boom section 19 and an end or tip section 22 with a boom tip housing 23. A grapple assembly 25 is suspended from the boom tip 22 by a coupling 26. In FIG. 1, the coupling 26 is assembled, and in FIG. 4, the coupling 26 is separated into upper and lower assemblies 26A, 26B, with the grapple assembly 25 detached from the vehicle 11 except through the instrumentality of a winch line 37. The grapple assembly 25 engages one end 27 of a load or drag logs.

Boom assembly 18 is rotated up and down in conventional fashion by a double acting hydraulic motor 29. The cylinder end 30 of motor 29 is connected to the boom mount 15 at locations just above the point of connection of the boom foot 19. The rod end 32 of the motor 29 is connected to a bracket 34 fixed to the midsection 21 of the boom assembly 18, at a point spaced away from it to give a lever arm or mechanical advantage for movement of the end of the boom up and down by the hydraulic cylinder 29. Hydraulic lines 35 provide hydraulic fluid to hydraulic cylinder assembly 29 in usual fashion.

A winch line 37 is spooled at one end over the winch drum 17. Winch line 37 includes one segment comprised of a wire rope 41, and another segment 42, of chain. The winch line 37 is played out and reeled in in conventional fashion upon operation of the winch drum 17 by the operator sitting in the operators cab.

Figure 2:
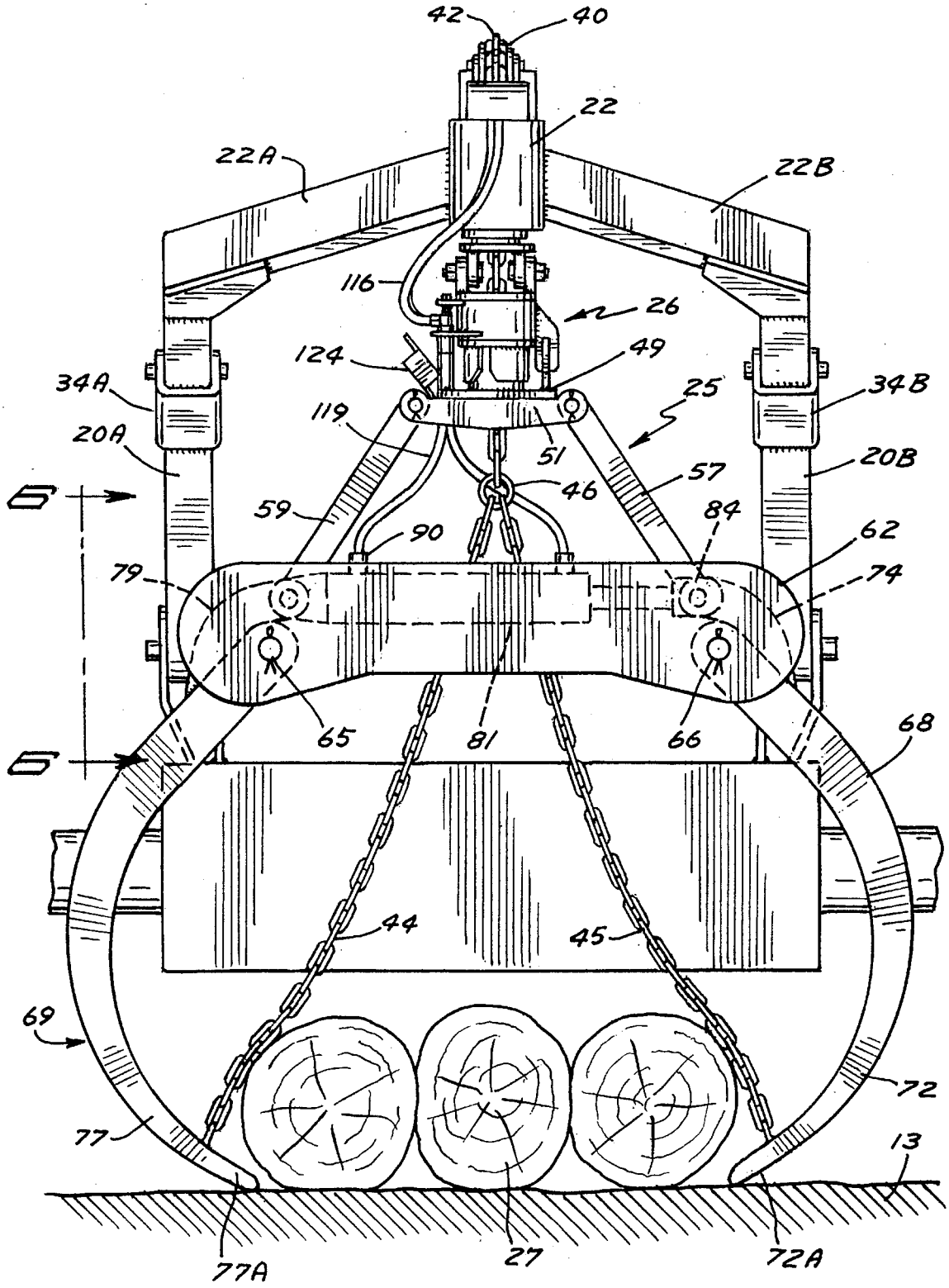
FIG. 2 is an end elevational view of the skidding grapple of FIG. 1, preparatory to engaging the end of a drag of logs that is situated on the ground.
Figure 3:
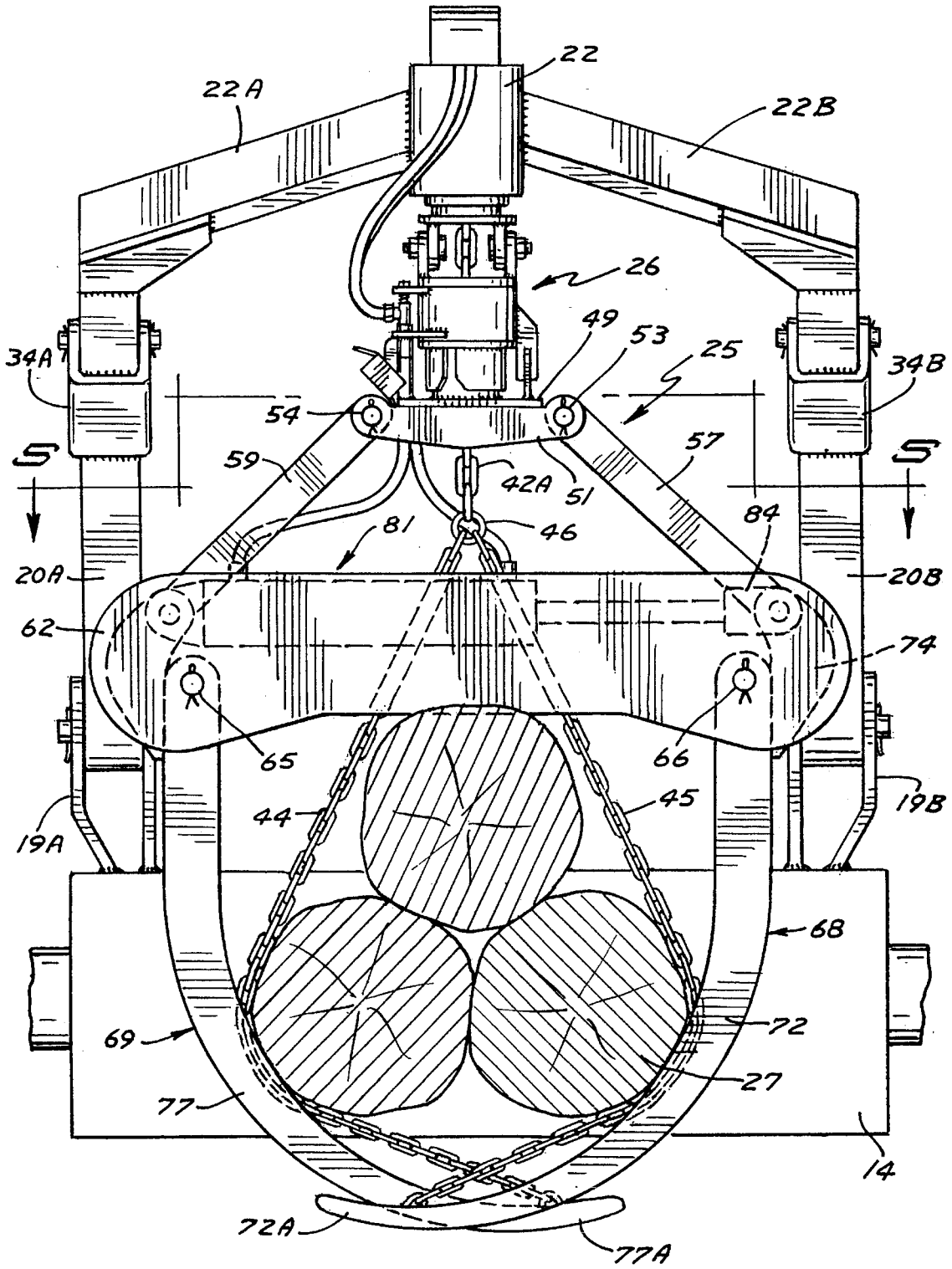
FIG. 3 is an end elevational view like that of FIG. 2, showing the grapple assembly of the skidding grapple having engaged the end of the drag of logs and having secured it or formed a noose around it preparatory to transport.

FIGS. 2 and 3 show boom assembly 18 as including parallel boom base sections 20A, 20B pivotally connected to and extending from boom mounts 19A, 19B fixed to the frame 14. Intermediate boom sections 22A, 22B diverge inwardly from the base sections 20A, 20B to the boom end section 22. One end of the grapple assembly coupling 26 is connected to the end section 22 of the boom assembly 18 by a conventional rotator mechanism located in the end section 22 in order to permit rotation of the grapple assembly 25 about a generally vertical axis. Grapple assembly coupling 26 is centrally open to permit passage of the winch line 37.

The wire rope end 41 of winch line 37 is attached to the winch drum 17. The chain end 42 is attached at its end to a choke line that is connected to the ends of the tines of the grapple assembly 25. The winch line 37 extends from winch drum 17, over the intermediate roller 38, and over the boom tip roller 40 (FIG. 2) and downwardly, unimpeded, through the boom tip and the grapple assembly coupling 26. The chain end 42A forms the stem of the choke line. The choke line includes chain legs 44, 45, connected to the stem 42A by a ring 46.

Grapple assembly 25 includes a pair of opposed grapple arms. The grapple arms swing on parallel axes but are offset with respect to one another, such that upon closure of the arms toward one another, the grapple tips bypass each other and continue along a pass that results in formation of a noose by the chain legs, which are fixed to the grapple tips. This noose engages the load encompassed by the grapple tines. Once the noose is formed about the load, it is tightened by spooling the winch line. This elevates the load to the extent that the top of the load is intercepted by the lower boundary of the grapple yoke. The weight of the load is borne by the noose and the winch line, but not by the grapple arms.

Figure 5:
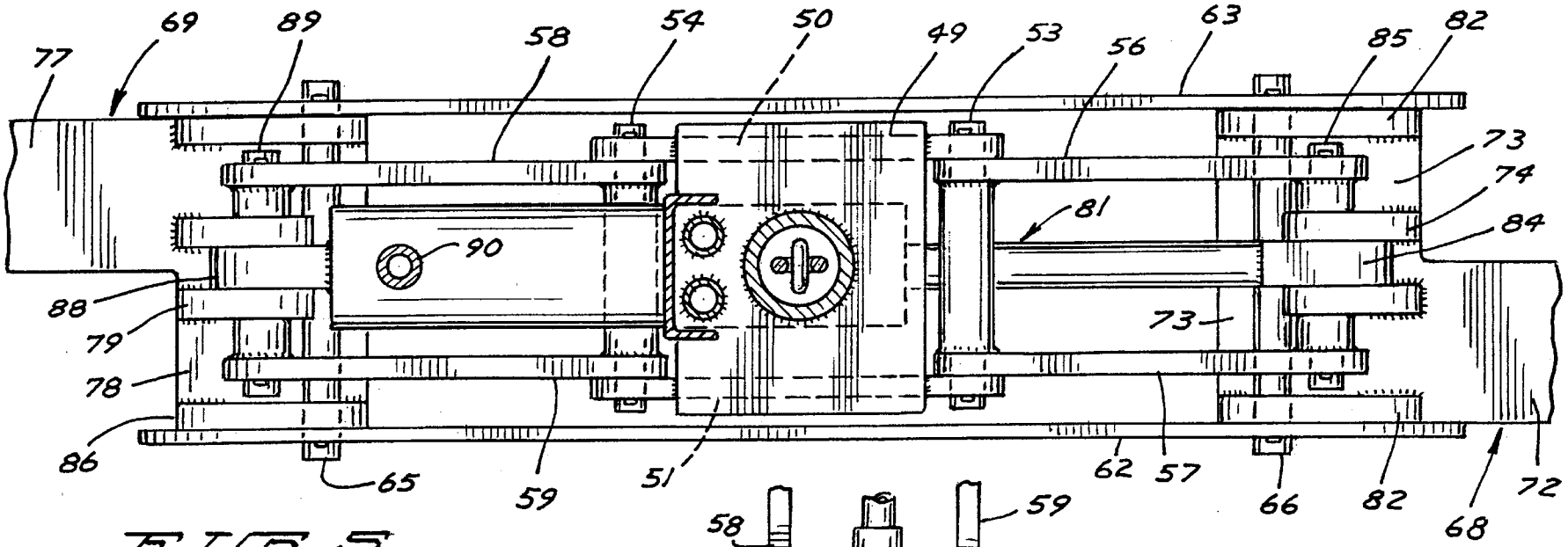
FIG. 5 is an enlarged sectional view of a portion of the skidding grapple shown in FIG. 3 taken along the line 5'5 thereof.
Figure 6:
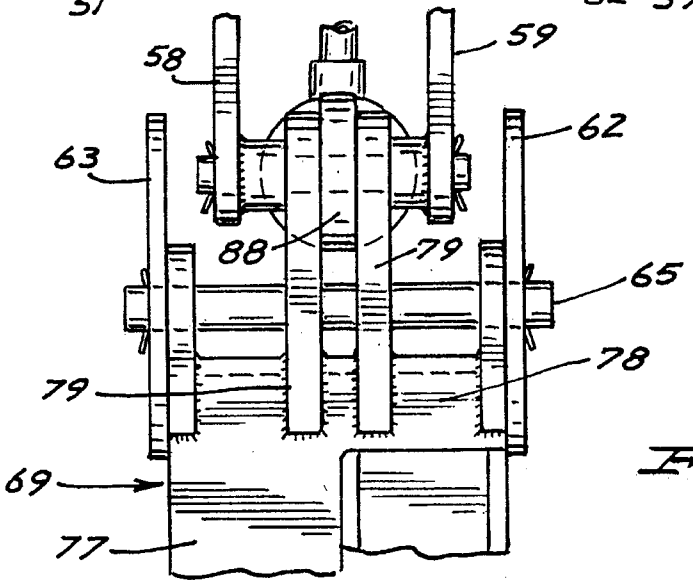
FIG. 6 is a sectional view of a section of that portion of that skidding grapple shown in FIG. 2 taken along the line 6—6 thereof.
Figure 7:
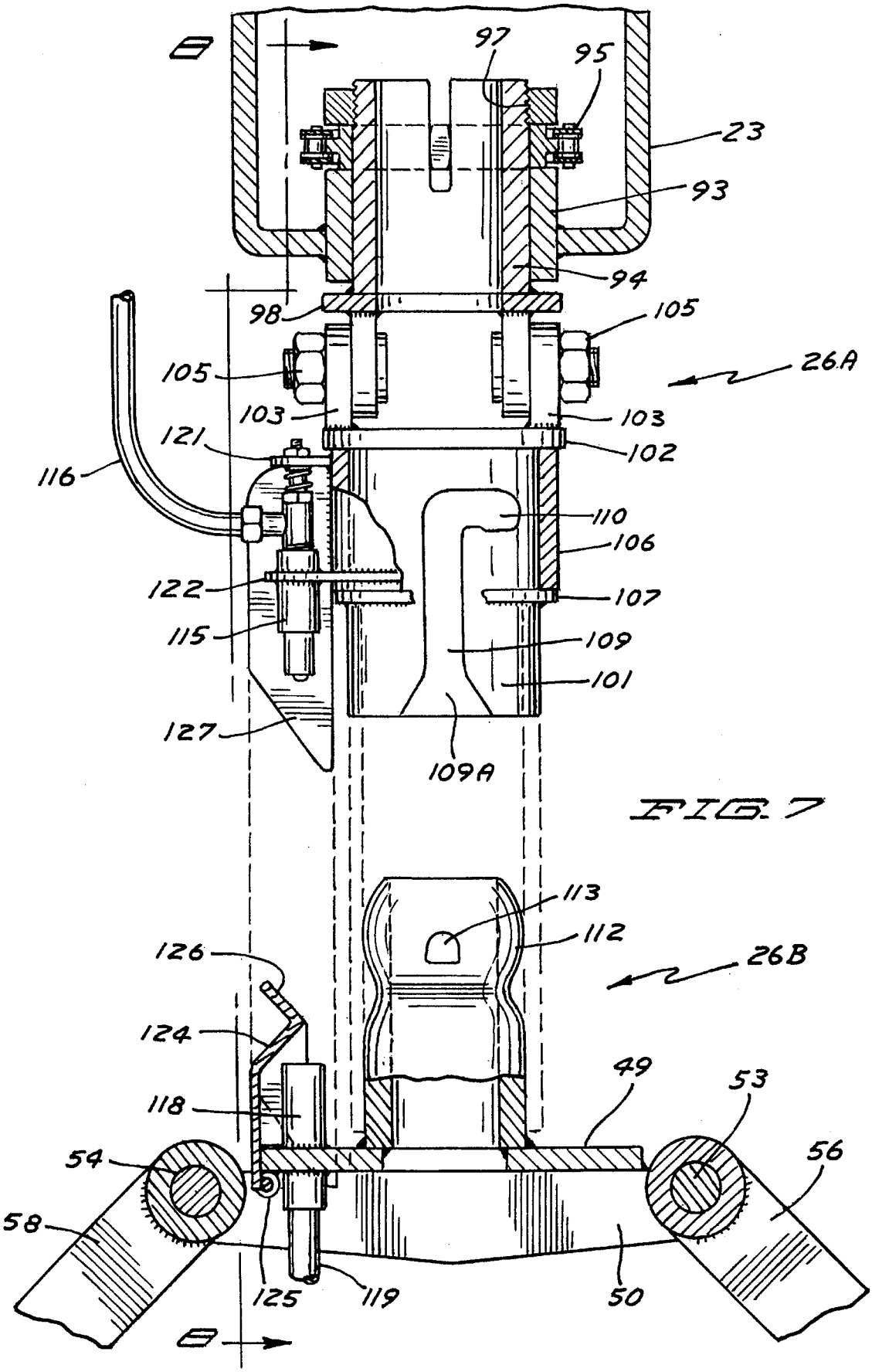

Grapple assembly 25 includes a flat mounting plate 49 that mounts the lower assembly 26B of the coupling 26. Parallel side members 50, 51 are connected to the edges of the plate 49 and extend outwardly. Link pins 53, 54 connect the outwardly-extended end portions of the side members 50, 51 (FIG. 5). Parallel connecting links 56, 57 are pivotally connected to the right link pivot pin 53 and extend downward therefrom. Opposite parallel links 58, 59 are connected to the left link pivot pin 54 on the left side of the assembly, as shown in FIG. 3, extending downwardly therefrom. Link members 56–59 connect the remainder of the grapple assembly to the coupling 26.

The grapple assembly includes a yoke having parallel, spaced apart yoke side plates 62, 63. Yoke side plates 62, 63 are attached together at either end by yoke connecting pins 65, 66. The grapple assembly has a pair of grapple arms 68, 69. The grapple arms 68, 69 are assembled between the yoke side plates 62, 63 by pivotal connection to the yoke connecting pins 65, 66.

First grapple arm 68 has an elongate, curved lifting tine 72, a hub 73, and a bifurcated lever arm 74. Second grapple arm 69 has an elongate, curved lifting tine 77, a hub 78 and a bifurcated lever arm 79. Grapple arms 68, 69 pivot upon the yoke connecting pins 65, 66 so that the tines 72, 77 move between open and closed positions. A hydraulic motor or power cylinder 81 is connected between the lever arms 74, 79 of the grapple arms to move them between positions.

As shown in FIG. 5, the hub 73 of the first grapple arm extends between the yoke side plates 63, 62 and has upwardly-extending bosses 82 in adjacent relationship to the yoke side plates. The second yoke connecting pin 66 extends through openings provided in the bosses 82 of the first grapple arm 68 for pivotally connecting the grapple arm to the yoke. Bifurcated lever arm 74 extends upwardly from the grapple hub 73 in a direction opposite the tine 72 and is engaged by the end 84 of the power cylinder 81. Power cylinder 81 is a rod-cylinder hydraulically-actuated motor of a conventional type. A link connecting pin 85 extends through suitable openings provided in the lower ends of the connecting links 56, 57, through the ends of lever arm 74 and through the end 84 of power cylinder 81.

The grapple hub 78 of the second grapple arm 69 extends between the yoke side plates 62, 63 of the grapple yoke at the end opposite that of the first grapple arm 68. Bosses 86 extend upwardly from hub 68 and are connected by the yoke connecting pin 65 to pivotally mount the grapple arm 69 to the yoke. The bifurcated ends of the lever arms 79 engage the end fitting 88 of the cylinder end of the power cylinder unit 81. A second link connecting pin 89 connects the lower ends of the links 58, 59 to the bifurcated ends of the lever arm 79 and the fitting 88 of the power cylinder 81. Power cylinder 81 derives hydraulic fluid from hydraulic fittings 90 via a control on the cab of the vehicle under the control of the operator. The ends of the power cylinder 81 are connected to the lever arms 74, 79 of the grapple arms 68, 69. Extension and retraction of the rod end 84 of the power cylinder 81 is effective to open and close the grapple tines. As can be seen in FIG. 5, the tines 72, 77 of the grapple arms 68, 69 are offset. They rotate about parallel axes, but in planes that are slightly offset in order to permit side-by-side passage of the tines upon rotational movement as occasioned by extension of the power unit 81.

As shown in FIGS. 2 and 3, chain legs 24, 25 of the choke line are connected at their respective ends to the tips 77A, 72A of tines 77, 72, respectively, of the grapple arms 69, 68. The chain legs are connected by connector ring 46 to the stem 42A of chain segment 42 of winch line 37. Through the use of power cylinder 81, the grapple legs 68, 69 can be spread in straddling relationship to a load 27 of logs resting on the ground 13. The power cylinder 81 is actuated to bring the tines 72, 77 together. The tips 72A, 77A are poised about the load 27 ready to penetrate beneath the load to lift the logs into a cradle defined by the curvature of the tines 72, 77. The chain legs 44, 45 are slack.

Upon engagement of the load, the grapple assembly goes from the position shown in FIG. 2 to that of FIG. 3. The tine tips 72A, 77A extend beneath the load 27. The tips are offset. They bypass one another, as shown in FIG. 3, such that the chain legs 44, 45 form a noose that engages the load 27. The chain legs 44, 45 become taught about the load. The noose is then closed to a point where the upper extremity of the load 27 is intercepted by the lower edge of the grapple yoke. This is accomplished through further movement of the tines 72, 77 or through elevation of the noose by spooling in the winch line 37. In the configuration shown in FIG. 3, the load 27 is ready for transport by the skidding grapple of the invention. This is also the configuration shown in FIG. 1.

A releasable coupling 26 connects the grapple assembly 25 and load 27 to the boom 18. FIG. 1 illustrates an arrangement for dragging the load 27 over the terrain with the end of the load 27 elevated. The operator can remotely manipulate the boom to place the end of the load in a position resting on the end of the vehicle, or with the end of the load partially engaged by a trailer (not shown) towed by the vehicle.

Coupling 26 is releasable. This can be done remotely by the operator from the cab. Coupling assemblies 26A, 26B separate from one another. This configuration is shown in FIG. 4. When particularly difficult terrain is encountered, the grapple assembly 25 and load 27 are left behind. Winch line 37 is spooled out and vehicle 14 advances, unencumbered by the load 27. Upon reaching a location somewhat ahead of the load, the winch drum 17 is activated to draw up the load 27.

Figure 7:
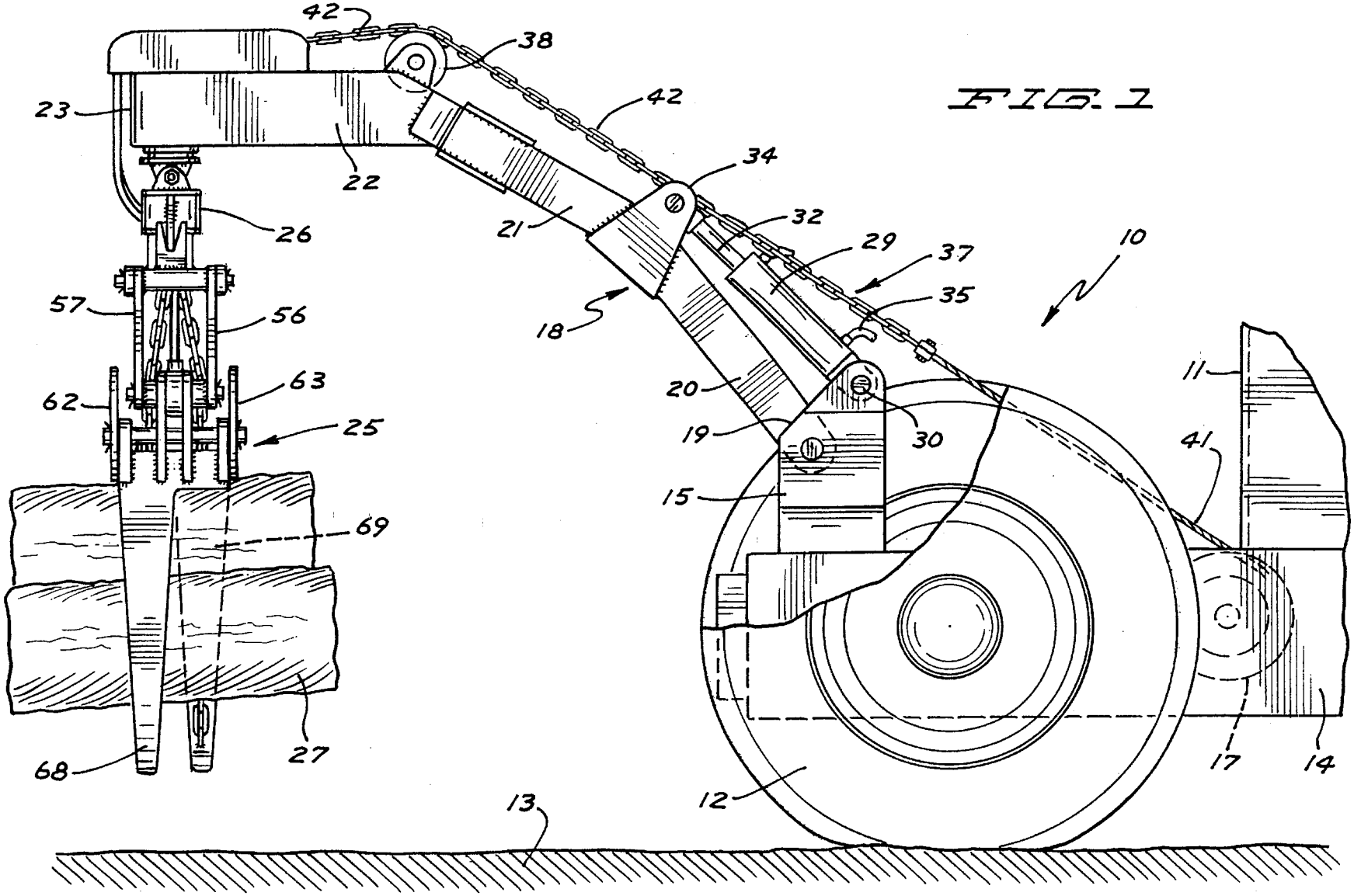
FIG. 7 is a side plan view of the coupling assembly that holds the grapple assembly to the boom, shown in a disconnected configuration.
Figure 8:
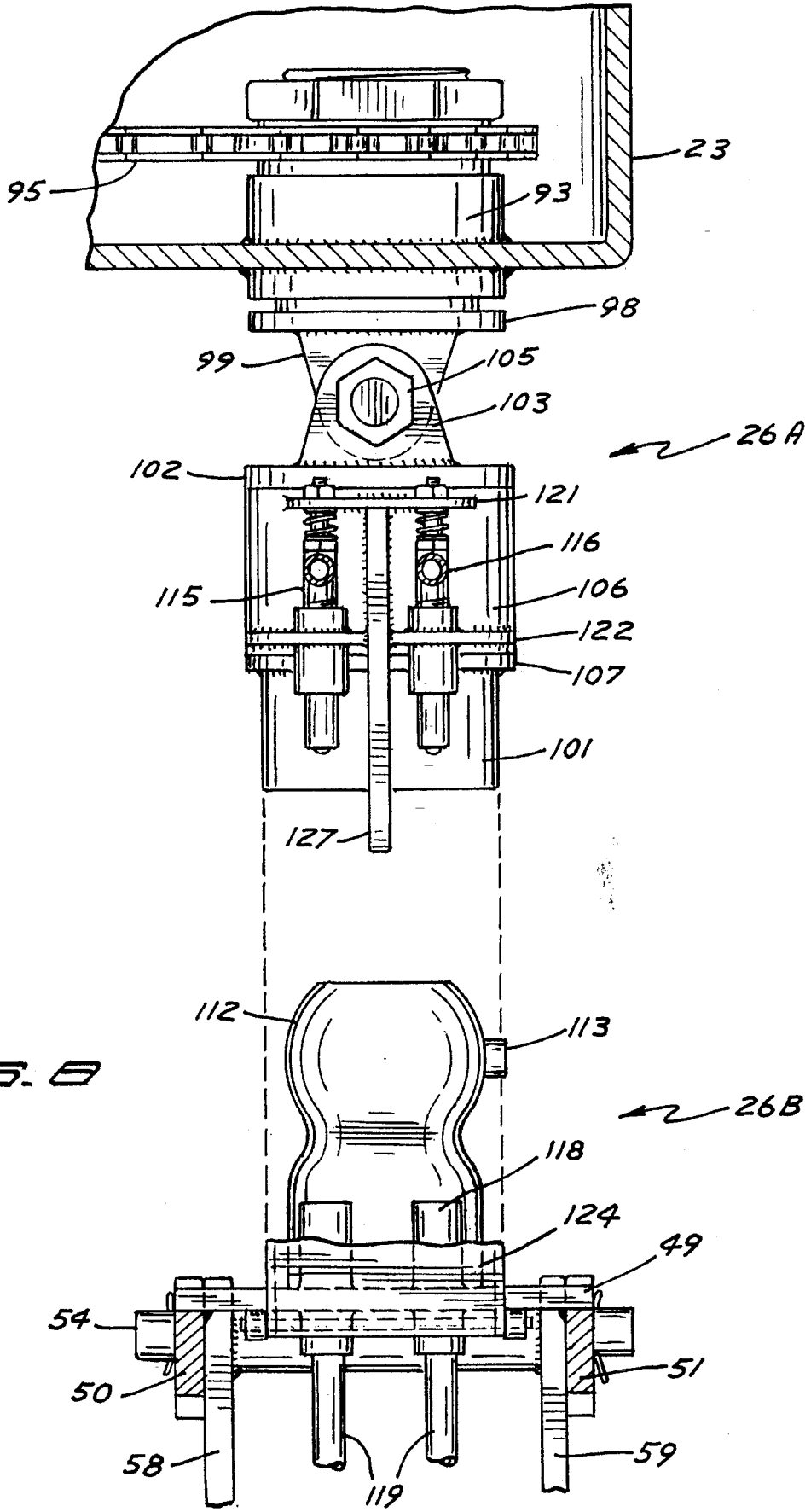
FIG. 8 is a side elevational view of the coupling assembly of FIG. 7 taken at right angles along line 8—8 thereof.
Figure 9:
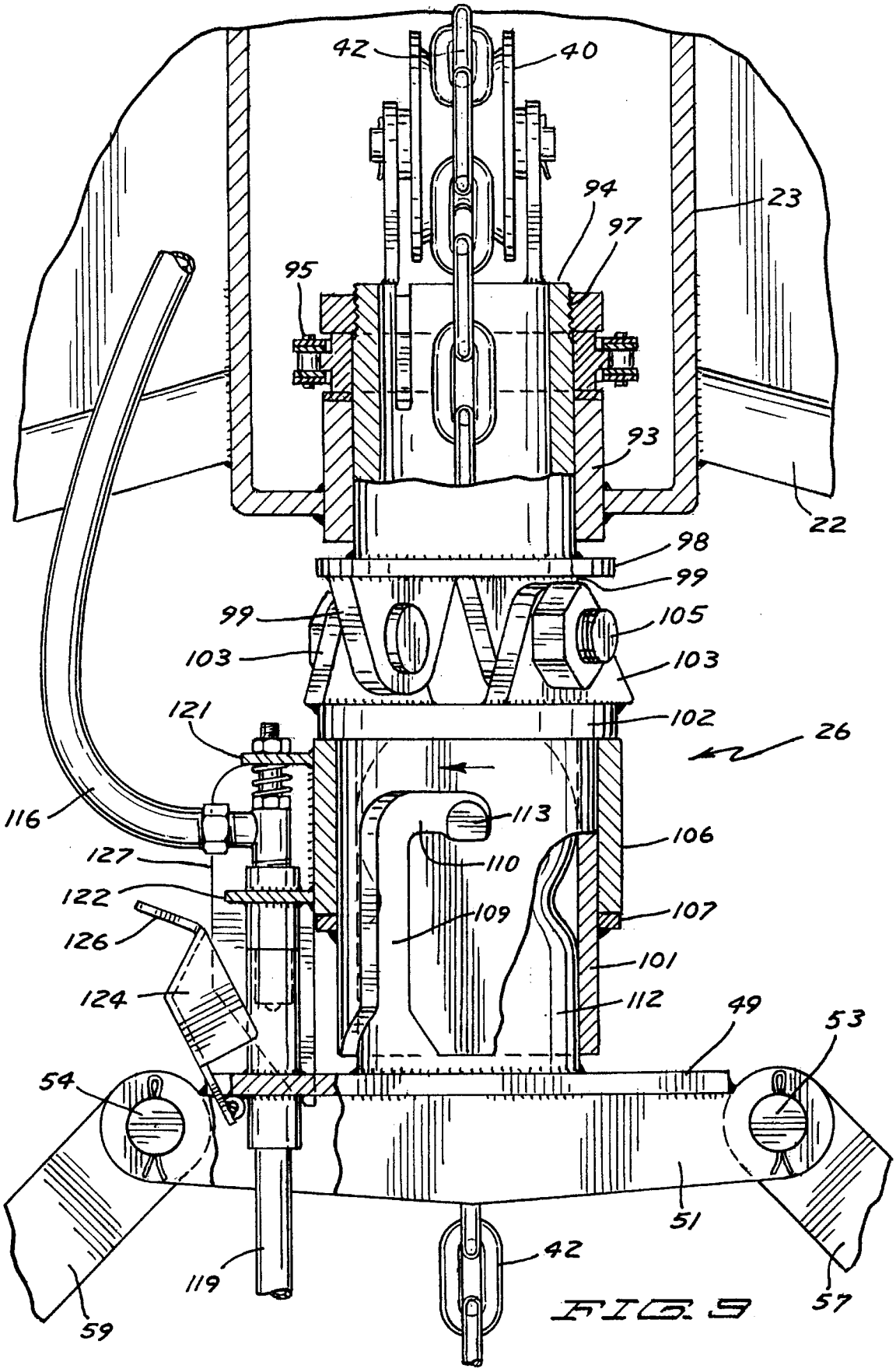
FIG. 9 is a side elevational view of the coupling assembly, as shown in FIG. 7, but in a connected relationship.

The releasable coupling 26 is shown in FIGS. 7–9. In FIGS. 7 and 8, the coupling is shown with the upper and lower assemblies 26A, 26B separated and poised in a position to be joined, with the winch line removed from the illustration for purposes of clarity. In FIG. 9, the coupling is shown in assembled or joined relationship, with the chain 42 in place.

The releasable coupling includes upper assembly 26A and lower assembly 26B, one a female assembly and the other a male assembly. The upper assembly is attached to the boom tip 18. The lower assembly is connected to the platform assembly, including the flat plate 49 and side members 50 that are attached to the grapple assembly 25. Coupling 26 carries hydraulic connectors to connect the power cylinder 81 to a remote supply of hydraulic fluid. The male assembly has a column having a pin or key, the female assembly has a sleeve with a bayonet-type locking slot. When the coupling parts are connected, the key rides in the bayonet-type slot and locks in an end portion of the slot.

Boom tip 23 contains a chain-driven rotor mechanism including a hub 93 fixed to the boom tip, and a rotator shaft 94 rotatably assembled in the hub 93 and driven by a drive chain 95 remotely controlled by the operator. Rotor shaft 94 is tubular to permit passage of the winch line 37. Rotator shaft 94 is fixed to hub 93 as by threads 97 permitting rotation upon operation of drive chain 95. A circular, centrally open plate 98 is fixed to the bottom of rotator shaft 94 and carries downwardly-depending pivot lugs 99.

Upper assembly 26A of the coupling 26 includes a tubular sleeve 101 having an end cap 102 fixed to the upper edge thereof. Pivot lugs 103 extend upwardly from the end cap 102. Pivot bolt assemblies 105 connect the pivot lugs 103 from the end cap 102 to the downwardly-depending lugs 99 that extend from the plate 88 on the rotator shaft attached to the boom. This permits rotation of the upper assembly 26A about a horizontal axis.

The top cap 102, attached to the sleeve 101, is centrally open to permit passage of the winch line.

A collar 106 surrounds the upper portion of sleeve 101. Collar 106 has an inside diameter slightly larger than the outside diameter of sleeve 101 to permit rotational sliding thereon. A bearing ring 107 is attached to sleeve 101. The collar 106 rests on the bearing ring 107. Collar 106 carries hydraulic connectors to supply hydraulic power to the grapple power cylinder unit 81.

Sleeve 101 has a bayonet mount-type locking slot 109 that extends from the lower edge thereof upwardly to an intermediate location on the side wall of sleeve 101. A circumferential leg 110 extends from the upper extremity of the slot on the side wall to form a bayonet fixture-type opening.

The lower assembly 26B of the coupling includes a tubular post or column 112 that is mounted on the mounting plate 49 of the grapple assembly. Column 112 has an outside diameter of a dimension to permit a slip fit within the inside diameter of sleeve 101. Column 112 has a locking pin or key 113. Key 113 fits into slot 109 of sleeve 101. Column 112 and sleeve 101 interlock by insertion of column 112 into the interior of sleeve 101 with locking pin 113 riding in slot 109. Slot 109 is dimensioned, and key 113 positioned, such that when sleeve 101 bottoms out on the platform 49, key 113 has reached the top of slot 109. Twisting of sleeve 101 is effective to move key 113 to the end of leg 110 to lock sleeve 101 with respect to column 112. This interlocks the upper assembly 26A to the lower assembly 26B which, in turn, locks the grapple assembly 25 to the tip of the boom assembly 18. Rotation of the sleeve 101 is accomplished by actuation of the rotator motor to move the chain 95 and the rotor shaft connected to the boom tip.

The upper and lower assemblies of the coupler 26 carry releasable hydraulic connectors for connection of a hydraulic fluid supply to the power cylinder 81. Upper assembly 26A carries a set of male connectors 115 connected by hydraulic lines 116 to a source of hydraulic fluid under pressure located on the vehicle cab and operated by the vehicle operator. Female hydraulic connectors 118 are located on the lower assembly 26B and are connected by hydraulic lines 119 to the fittings 90 on power cylinder 81 to supply hydraulic fluid for operation of that motor unit.

A pair of male connectors 115 is attached to the collar 106 so as to stay in place with respect to the female connectors upon relative rotation of the column 112 and the sleeve 101 between locked and unlocked positions. Upper and lower connecting plates 121, 122 are fixed to the side of the collar 106 and mount the male connectors 115 in parallel, downwardly depending relationship. The female connectors 118 are mounted to the mounting plate 49 of the grapple assembly 25 in spaced, parallel relationship, and, in the position of FIGS. 7 and 8, positioned for receipt of the male connectors.

A housing 124 covers the female connectors 118 when they are disconnected from the upper coupling assembly 26A. Housing 124 is hingedly connected by a spring hinge 125 to the mounting plate 49. Housing 124 has a lip 126. In the closed configuration, housing 124 covers the female connectors 118 on one side with the column 112 on the opposite side. Lip 126 extends outwardly in diverging relationship from the side wall of the column 112.

A wedge-shaped rib 127 is fixed to the collar 106 between the male connectors 115. Rib 127 has a pointed apex 129 which extends downwardly a distance beyond the ends of the male connectors 115 and has a canted surface for interaction with the lip 126 of housing 124. The apex of the rib 127 fits between lip 126 and the side wall of column 112. As the upper and lower assemblies 26A, 26B advance toward one another, lip 126 of housing 124 rides along the canted edge of rib 127 to move the housing away from female connectors 118 for access by male connectors 115.

In the operation of coupling 26, from the coupled position of FIG. 9, the chain 95 is actuated to rotate the rotator shaft 94 in a direction to move the sleeve 101 to a position where the locking pin 113 moves to the vertical portion of the locking slot 110. In doing so, the sleeve 101 slides relative to the collar 106. The coupler is then disengaged simply by lifting movement moving the upper assembly 26A away from the lower assembly 26B.

In the coupling operation, the reverse events occur. The sleeve 101 is aligned with the column 112, with the locking pin 113 aligned with the fan-shaped opening 109A aligned with the locking slot 109. The upper coupling assembly is lowered onto the lower coupling assembly by operation of the boom. At the same time, the rib 127 opens the housing 124 to expose the female hydraulic connectors 118. As the locking pin 113 rides in the locking slot 109, the male and female hydraulic connectors are engaged. When the locking pin 113 hits the top of the slot, the rotator shaft is engaged to move the locking pin circumferentially into the legs 110 of the slot 109.

The hydraulic lines 119 leading from the female connectors 118 extend to the hydraulic fittings 90 on the grapple power unit 81 for operation of the grapple arms.

The embodiments of the invention in which an exclusive property or privilege is claimed, are defined as follows:

1. A skidding grapple mounted on a tow vehicle, comprising:

a boom assembly mounted on the tow vehicle, having a boom with an outer boom end;

a winch drum mounted on the tow vehicle and a winch line connected at one end to the winch drum for spooling in over the winch drum;

a grapple assembly connected to the end of the boom;

means for lifting the boom to elevate and lower the grapple assembly;

said grapple assembly including a grapple yoke, and first and second grapple arms pivotally connected to the grapple yoke for pivotal movement about parallel axes;

said first and second grapple arms having first and second tines movable between open and closed positions;

said first and second grapple arms mounted to the grapple yoke so that the tines are located in off-set relationship so that the ends of the tines bypass one another when moving together;

a choke line having a first leg and a second leg, one end of the first leg connected to the end of the first tine, one end of the second leg connected to the end of the second tine so that the ends of the legs bypass with the ends of the tines, the other end of each leg being connected to the winch line;

a releasable coupling connecting the grapple assembly to the end of the boom, said releasable coupling having an upper assembly connected to the end of the boom, and a lower assembly connected to the grapple assembly, said upper assembly and lower assembly having openings that are aligned when the assemblies are connected to form a central opening through the coupling, said winch line extending from the winch drum through the central opening of the coupling to the grapple assembly; and power means for opening and closing the grapple tines, permitting engagement of a load by the tines and forming a noose around the load by moving from an open position to a closed position encompassing a load and the first and second tines bypassing one another whereby the first and second legs of the choke line form a noose about the load for carrying the load.

2. The skidding grapple of claim 1 wherein:

said power means to open and close the grapple arms includes a hydraulic power unit, said coupling including releasable hydraulic connector means.

3. The skidding grapple of claim 2 including:

a rotator mechanism connecting the upper assembly of the coupling to the end of the boom; and one of said assemblies including a sleeve with a bayonet-mount slot, the other assembly including a column with a key that fits in the bayonet-mount slot of the sleeve of the other assembly.

4. The skidding grapple of claim 1 including:

said grapple yoke having first and second side plates;

said first and second grapple arms having first and second grapple hubs connected to and between the yoke side plates by pivot pins; and said grapple tines extending from the grapple hubs.

5. The skidding grapple of claim 4 including:

first and second grapple lever arms extended from the first and second grapple hubs, said power means including a hydraulic motor connected between the first and second grapple lever arms.

6. The skidding grapple of claim 5 including:

pulley means on the end of the boom; and said winch line extended from the winch drum, over the pulley means, and through the central opening of the coupling means no the choke line.

7. The skidding grapple of claim 6 wherein:

said winch line includes a wire rope segment and a chain segment, said wire rope segment connected to the winch drum, said first and second legs of the choke line connected to the chain segment.

8. A skidding grapple mounted on a tow vehicle, comprising:

a boom assembly mounted on the tow vehicle, having a boom with an outer boom end;

a winch drum mounted on the tow vehicle and a winch line connected at one end to the winch drum for spooling in over the winch drum;

a grapple assembly connected to the end off the boom;

means for lifting the boom to elevate and lower the grapple assembly;

said grapple assembly including a grapple yoke, and first and second grapple arms pivotally connected to the grapple yoke for pivotal movement about parallel axes;

said first and second grapple arms having first and second tines movable between open and closed positions;

said first and second grapple arms mounted to the grapple yoke so that the tines are located in off-set relationship so that the tine ends bypass one another when moving together;

a choke line having a first leg and a second leg, one end of the first leg connected to the end of the first tine, one end of the second leg connected to the end of the second tine, the other end of each leg being connected to the winch line so that the legs of the choke line form a noose around the load upon closing the grapple tines about a load;

power means for opening and closing the grapple tines, permitting engagement of a load by the tines and forming a noose around the load by moving from an open position to a closed position encompassing a load and the first and second tines bypassing one another whereby the first and second legs of the choke line form a noose about the load for carrying the load;

coupling means connecting the grapple assembly to the end of the boom, said coupling means having a central opening;

pulley means on the end of the boom; and said winch line extended from the winch drum, over the pulley means, and through the central opening of the coupling means to the choke line.

9. The skidding grapple of claim 8 wherein:

said winch line includes a wire rope segment and a chain segment, said wire rope segment connected to the winch drum, said first and second legs of the choke line connected to the chain segment.

10. The skidding grapple of claim 8 including:

said grapple yoke having first and second side plates;

said first and second grapple arms having first and second grapple hubs connected to and between the yoke side plates by pivot pins; and said grapple tines extending from the grapple hubs.

11. The skidding grapple of claim 10 including:

first and second grapple lever arms extended from the first and second grapple hubs, said power means including a hydraulic motor connected between the first and second grapple lever arms.

12. The skidding grapple of claim 8 wherein:

said coupling means connecting the grapple assembly to the end of the boom is a releasable coupling having an upper assembly connected to the end of the boom, and a lower assembly connected to the grapple assembly, said winch line extending through said coupling from the winch drum to the grapple assembly.

13. The skidding grapple of claim 12 wherein:

said power means to open and close the grapple arms includes a hydraulic power unit, said coupling including releasable hydraulic connector means.

14. The skidding grapple of claim 13 including:

a rotator mechanism connecting the upper assembly of the coupler to the end of the boom; and one of said assemblies including a sleeve with a bayonet-mount slot, the other assembly including a column with a key that fits in the bayonet-mount slot of the sleeve of the other assembly.

15. A skidding grapple mounted on a tow vehicle, comprising:

a boom assembly mounted on the tow vehicle, having a boom with an outer boom end, a winch line, and a winch drum;

a grapple assembly;

said grapple assembly having first and second grapple arms to open and close about a load;

grapple power means connected to the grapple arms to open and close the arms;

a first end of the winch line connected to the winch drum for spooling the winch line in and out, and a second end of the winch line connected to the grapple assembly;

a coupling having a central opening and releasably connecting the grapple assembly to the boom, said coupling having first and second releasably connected assemblies, said first coupling assembly connected to the outer boom end, said second coupling assembly connected to the grapple assembly;

means for connection and release of the first and second coupling assemblies;

pulley means on the outer end of the boom;

said winch line extending from the drum, trained over the pulley means, extending through the central opening of the coupling, to the grapple assembly, so that the grapple assembly can be released from the boom upon separation of the coupling assemblies, and remain connected to the tow vehicle by the winch line, as the tow vehicle moves away from the grapple assembly while spooling out the winch line, and then reconnected to the tow vehicle by spooling in the winch line;

said first and second grapple arms having first and second tines movable between open and closed positions;

a grapple yoke;

said first and second grapple arms mounted to the grapple yoke so that the tines are located in offset relationship so that the tine ends bypass one another when moving together;

a choke line having a first leg and a second leg, one end of the first leg connected to the end of the first tine, one end of the second leg connected to the end of the second tine, the other end of each leg being connected to the winch line;

said power means for opening and closing the grapple arms permitting engagement of a load by the tines moving from the open position to a closed position encompassing the load with the first and second tines bypassing one another whereby the first and second legs of the choke line form a noose about the load for carrying the load; and said means for spooling in the winch line operable to tighten the noose about the load.

16. The skidding grapple of claim 15 wherein:

said coupling is a bayonet-type connector, one of said coupling assemblies being a female connector, including a sleeve with a bayonet-type locking slot; and the other coupling assembly being a male connector, including a column with a locking key engageable with the locking slot on the sleeve of the female connector.

17. The skidding grapple of claim 16 including:

female hydraulic connectors carried by one of the coupling assemblies, and male hydraulic connectors carried by the other, said hydraulic connectors positioned to come together upon connection of the coupling assemblies.

18. The skidding grapple of claim 17 including:

rotator means on the outer boom end for rotation of the first coupling assembly;

a rotating collar fixed to the first assembly; and the hydraulic fittings connected to the first assembly being connected to the rotating collar.

19. The skidding grapple of claim 18 wherein:

said first coupling assembly is the female assembly, said rotating collar being assembled in surrounding relationship to the sleeve;

said grapple assembly including a flat plate connected to the grapple arms, said second coupling assembly being said male assembly with said column mounted on the flat plate; and the hydraulic connectors connected to the second assembly being mounted on the flat plate.

* * * * *